US007546919B2

(12) United States Patent
Lee

(10) Patent No.: US 7,546,919 B2
(45) Date of Patent: Jun. 16, 2009

(54) CAP WITH STORAGE CHAMBER FOR SECONDARY MATERIAL AND THE PRODUCT WITH THE SAME

(76) Inventor: Jung Min Lee, 10-92, Sibum Apt. 50 Yeuido-dong, Youngdungpo-gu, Seoul (KR) 150-894

( * ) Notice: Subject to any disclaimer, the term of this patent is extended or adjusted under 35 U.S.C. 154(b) by 111 days.

(21) Appl. No.: 10/579,953

(22) PCT Filed: Nov. 22, 2004

(86) PCT No.: PCT/KR2004/003014

§ 371 (c)(1),
(2), (4) Date: May 22, 2006

(87) PCT Pub. No.: WO2005/049430

PCT Pub. Date: Jun. 2, 2005

(65) Prior Publication Data

US 2007/0089905 A1 Apr. 26, 2007

(30) Foreign Application Priority Data

Nov. 22, 2003 (KR) ..... 10-2003-0084256
Nov. 22, 2003 (KR) ..... 10-2003-0084257
Apr. 16, 2004 (KR) ..... 10-2004-0027303
Aug. 13, 2004 (KR) ..... 10-2004-0064913

(51) Int. Cl.
*B65D 25/08* (2006.01)
*B67D 5/60* (2006.01)

(52) U.S. Cl. ..... 206/221; 206/217; 206/220; 222/145.5

(58) Field of Classification Search ..... 206/217, 206/219, 221, 222; 222/145.5, 522–525
See application file for complete search history.

(56) References Cited

U.S. PATENT DOCUMENTS 3,924,741 A * 12/1975 Kachur et al. ..... 206/221

(Continued)

FOREIGN PATENT DOCUMENTS

EP 1122186 A1 8/2001

(Continued)

*Primary Examiner*—Jila M Mohandesi
*Assistant Examiner*—Jose S Stephens, III
(74) *Attorney, Agent, or Firm*—Westman, Champlin & Kelly, P.A.

(57) ABSTRACT

A cap containing a secondary material includes a fixing member fixed on a container, the fixing member having a hollow main body and a supporting tube extending downward from an inner surface of the hollow main body, the supporting tube having a material exhausting portion and a seal member formed on the lower end of the supporting tube, and a movable member coupled to the fixing member, the movable member having a main body coupled on the main body of the fixing member and a tube extending downward from the main body to define a storage chamber for the secondary material, the tube being provided with an opened lower end through which the secondary material can be filled in the storage chamber, the opened lower end of the tube being tightly interlocked with the seal member formed on the supporting tube of the fixing member after the secondary material is filled in the storage chamber and the movable member is coupled to the fixing member and being released from the seal member so that the secondary material can be mixed with a primary material contained in the container by being exhausted into the bottle through the material exhausting portion formed on the supporting tube of the fixing member.

11 Claims, 2 Drawing Sheets

U.S. PATENT DOCUMENTS

| | | | | |
|---|---|---|---|---|
| 4,315,570 | A * | 2/1982 | Silver et al. | 206/221 |
| 4,865,189 | A * | 9/1989 | Guerra et al. | 206/221 |
| 5,373,937 | A * | 12/1994 | Lamboy | 206/221 |
| 5,593,028 | A * | 1/1997 | Haber et al. | 206/221 |
| 5,634,714 | A * | 6/1997 | Guild | 366/130 |
| 5,826,713 | A * | 10/1998 | Sunago et al. | 206/222 |
| 5,845,814 | A * | 12/1998 | Nobbio | 222/129 |
| 5,971,140 | A * | 10/1999 | Frutin | 206/222 |
| 6,257,428 | B1 * | 7/2001 | Caola | 215/11.1 |
| 6,435,341 | B1 * | 8/2002 | Nobbio | 206/219 |
| 6,474,861 | B1 * | 11/2002 | De Laforcade | 366/130 |
| 6,655,525 | B2 * | 12/2003 | Song | 206/222 |
| 6,921,087 | B2 * | 7/2005 | Takahashi et al. | 277/628 |
| 6,926,138 | B1 * | 8/2005 | Basham et al. | 206/222 |
| 2002/0020637 | A1 * | 2/2002 | De Laforcade | 206/219 |
| 2002/0053524 | A1 * | 5/2002 | Alticosalian | 206/219 |
| 2002/0096440 | A1 * | 7/2002 | Kasuya | 206/222 |
| 2002/0110744 | A1 * | 8/2002 | Williams | 430/5 |

FOREIGN PATENT DOCUMENTS

| | | |
|---|---|---|
| JP | 08072921 | 3/1996 |
| WO | WO98/38104 A1 | 9/1998 |

* cited by examiner

[Fig. 1]
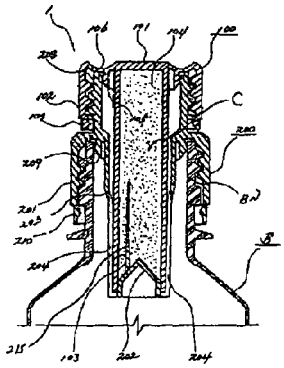
[Fig. 2]
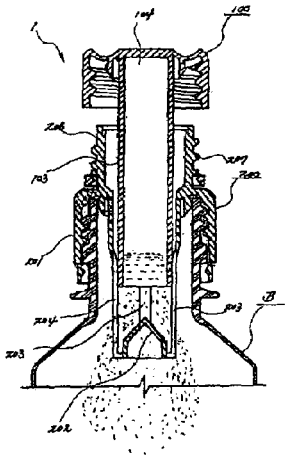
[Fig. 3]
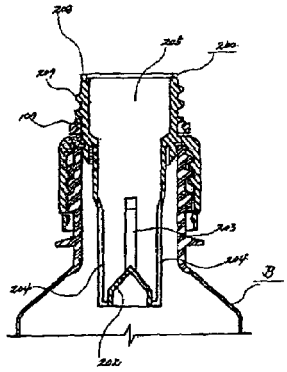
[Fig. 4]
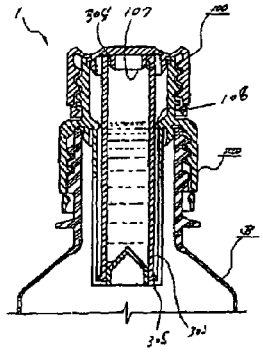

[Fig. 5]
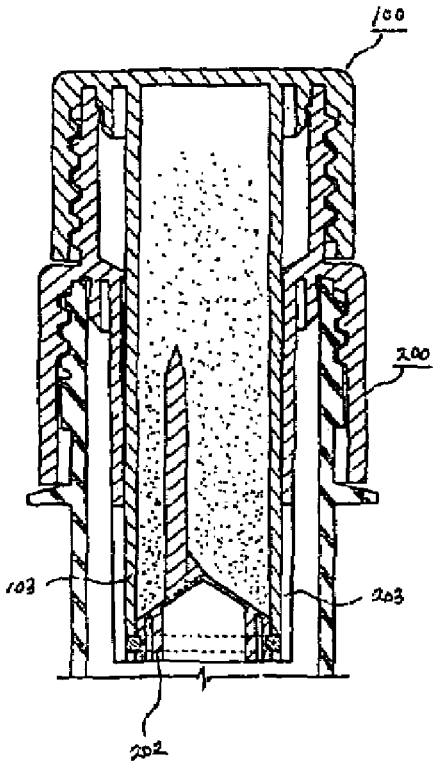
[Fig. 6]
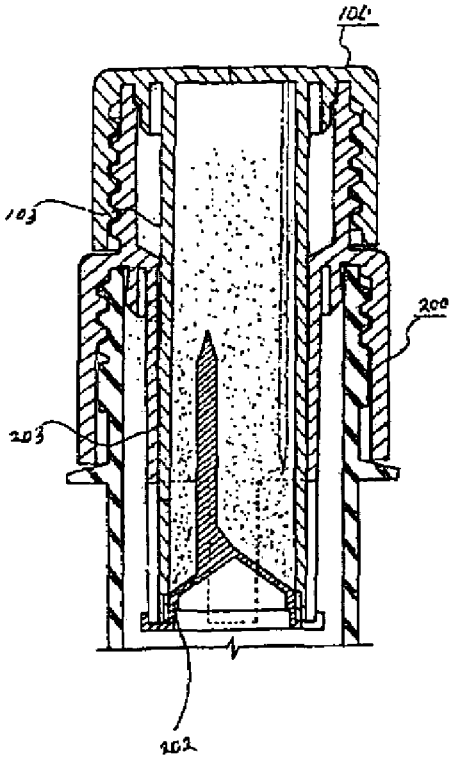

CAP WITH STORAGE CHAMBER FOR SECONDARY MATERIAL AND THE PRODUCT WITH THE SAME

TECHNICAL FIELD

The present invention relates to a cap with a storage chamber for secondary material and a product employing the same, and more particularly, to a cap with a storage chamber for secondary material that will be mixed with primary material contained in a container associated with the cap by simply opening the cap.

BACKGROUND ART

In a variety of industrial fields, it is sometimes necessary to mix two or more different materials with each other to prepare a mixture, prior to using the mixture.

For example, when it comes to beverage industrial field, users wish to add a variety of flavors or vitamins to the water. To this end, the user purchases the flavors or vitamins and the separated bottle water and mixes the flavors or vitamins with the bottle water. However, it is very troublesome for the user to do so.

DISCLOSURE OF INVENTION

Technical Problem

Therefore, the present invention has been made in an effort to solve the above-described problems.

It is an object of the present invention to provide a cap with a storage chamber for a secondary material that will be mixed with a primary material contained in a container associated with the cap by simply opening the cap.

It is another object of the present invention to provide a product employing a cap with a storage chamber for a secondary material.

Technical Solution

To achieve the above objects, the present invention provides a cap containing a secondary material, which includes a fixing member fixed on a container, the fixing member having a hollow main body and a supporting tube extending downward from an inner surface of the hollow main body, the supporting tube having a material exhausting portion and a seal member formed on the lower end of the supporting tube, and a movable member coupled to the fixing member, the movable member having a main body coupled on the main body of the fixing member and a tube extending downward from the main body to define a storage chamber for the secondary material, the tube being provided with an opened lower end through which the secondary material can be filled in the storage chamber, the opened lower end of the tube being tightly interlocked with the seal member formed on the supporting tube of the fixing member after the secondary material is filled in the storage chamber and the movable member is coupled to the fixing member and being released from the seal member so that the secondary material can be mixed with a primary material contained in the container by being exhausted into the bottle through the material exhausting portion formed on the supporting tube of the fixing member.

Advantageous Effects

The present invention has an advantage in that an active layer of a nitride semi-conductor light emitting device can have an improved crystallinity, and an improved light output and reliability.

DESCRIPTION OF DRAWINGS

The accompanying drawings, which are included to provide a further understanding of the invention and are incorporated in and institute a part of this specification, illustrate embodiments of the invention and together with the description serve to explain the principles of the invention.

In the drawings:

FIG. 1 is a sectional view illustrating an association of a container and a cap according to an embodiment of the present invention;

FIG. 2 is a sectional view illustrating an operating state of a cap according to an embodiment of the present invention;

FIG. 3 is a sectional view illustrating a cap associated with a container according to another embodiment of the present invention;

FIG. 4 is a sectional view illustrating a cap associated with a container according to another embodiment of the present invention;

FIG. 5 is sectional view illustrating a cap associated with a container according to another embodiment of the present invention; and FIG. 6 is a sectional view illustrating a cap associated with a container according to another embodiment of the present invention.

MODE FOR INVENTION

Preferred embodiments of the present invention will be described more in detail hereinafter in conjunction with the accompanying drawings. Wherever possible, the same reference numerals will be used through the drawings to refer to the same or like parts.

FIG. 1 shows a cap according to an embodiment of the present invention, which is associated with a container.

The inventive cap 1 includes a fixing member fixed on a container such as a bottle B and a movable member 100 coupled to the fixing member 200 to define an enclosed storage chamber by being associated with the fixing member 200.

The fixing member 200 includes a hollow main body having a sidewall 201 coupled to a container and a spouting portion 208 extending upward from the sidewall 201. In this embodiment, a bottle B is exemplified as a the container. Therefore, the sidewall 201 may be designed to be screw-coupled to a neck BN of the bottle B. However, the present invention is not limited to this. The sidewall 201 may be coupled to other types of containers such as a flexible pouch container through other coupling method. The fixing member 200 further includes a supporting tube 203 extending from an inner surface of the sidewall 201, the supporting tube 203 being provided with a material exhausting portion 204, a seal portion 202 formed on a bottom of the supporting portion 203, and the spouting portion 208 extending upward from the sidewall 201 to communicate with the material exhausting portion 204. The fixing member 200 may further include a seal projection 209 formed on an inner surface of the sidewall 201 to form a seal by tightly contacting an inner surface of the neck BN of the bottle B. A tamper-proof 210 may be formed on a lower end of the sidewall 201.

The movable member 100 is designed to be coupled around the fixing member 200.

The movable member 100 includes a main body having a top wall 101 and a sidewall 102 extending from the top wall 101 and coupled around the spouting portion 208 of the fixing member 200, and a tube 103 extending downward from a bottom of the top wall 101, the tube 103 defining a storage chamber 104 and having an opened bottom through which a secondary material can be filled in the storage chamber 104. The secondary material may be powder, liquid concentration, granules or other chemical materials that will be mixed with a primary material contained in the container. Preferably, the top wall 101 is connected to the sidewall 102 by an elastic portion 106. A seal projection extends downward from a bottom of the elastic portion 106 to tightly contact an inner surface of the spouting portion 208 of the fixing member 200. A tamper-proof 107 may be formed on a lower end of the sidewall 102 of the movable member 100.

In a state where the storage chamber 104 is filled with the secondary material C, the movable member 100 is coupled to the fixed member 200 such that the opened bottom of the tube 103 can be tightly locked with the seal member 202 formed on the bottom of the supporting tube 203 of the fixing member 200, thereby sealing the storage chamber 104.

In the drawing, the sidewall 102 of the movable member 100 is screw-coupled to an outer circumference of the spouting portion 208. However, the present invention is not limited to this case. For example, the movable member 100 may be fitted on the fixing member through a forcibly fitting manner.

Preferably, a stirring pin 215 is formed extending upward from the seal member 202 so that the secondary material C can be more effectively exhausted of the tube by stirring the secondary material C when the movable member 100 is unscrewed from the fixing member 200. More preferably, the string pin 215 is formed on an eccentric portion of the seal member 202 so that it rotates tracking a circular when the movable member 100 is unscrewed from the fixing member.

The operation of the above-described cap will be described in more detail hereinafter.

The secondary material C is first filled in the storage chamber 104 defined by the tube 103 of the movable member 100. Then, the fixing member 200 is assembled with the movable member 100 such that the bottom of the tube 103 can be tightly coupled to the seal member 202 to air-tightly confine the secondary material C in the storage chamber 104.

In this state, the fixing member 200 is fixed on the container (bottle B). That is, as shown in the drawing, the sidewall 201 of the fixing member 200 is screw-coupled to the neck BN of the bottle B to provide a seal between the neck BN and the inner surface of the sidewall 201. This state is shown in FIG. 1.

In this state, when the movable member 100 is unscrewed from the fixing member 200 (i.e., from the spouting portion 208 of the main body), as shown in FIG. 2, the bottom of the tube 103 of the movable member 100 is released from the seal member 202 formed on the bottom of the supporting tube 203. At this point, as the seal between the tube 103 and the supporting tube 203 is removed, the secondary material contained in the storage chamber 104 defined by the tube 103 is exhausted into the bottle B and mixed with the primary material such as beverage including water. Then, in a state where the movable member 100 is completely removed from the fixing member 200, the user can use or drink the mixture through the spouting portion 208 of the fixing member 200. This state is shown in FIG. 3. Alternatively, the user can use or drink the mixture through the neck BN of the bottle B after removing the fixing member 200 from the neck BN.

FIG. 4 shows a cap according to another embodiment of the present invention.

A cap of this embodiment is substantially identical except for the followings.

In this embodiment, a tube 303 is separated from the movable member 100. That is, the tube 303 is provided at an opened top with an inner circumferential projection 304 and a hook projection 107 is formed on the top wall of the movable member 100. Therefore, the opened top of the tube 303 is inserted around the hook projection 107 such that the hook projection 107 and the inner circumferential projection 304 are tightly interlocked.

An inner circumferential projection 108 is formed on the inner surface of the fixing member 200 to tightly contact the outer surface of the tube 303. Therefore, when the movable member 100 is unscrewed from the fixing member 200 and opened to a pre-determined level to release the secondary material into the container, the user can shake the bottle B to effectively mix the secondary material with the primary material contained in the bottle B. That is, in this case, since the inner circumferential projection 108 tightly contacts the tube 303, even when the user shakes the bottle B, the mixture is not leaked out of the bottle B.

The tube 303 is further provided at a bottom with an inner circumferential projection 305. When the movable member 100 is unscrewed from the fixing member 200, the movable member 100 and the tube 300 move upward until the inner circumferential projection 305 is hooked on the inner circumferential projection 108. In this state, the tube 300 is not moved upward any more and the hook projection 107 of the movable member 100 and the inner circumferential projection 304 are released from each other, thereby removing the movable member 100 from the fixing member 200 as well as the tube 303. In this state, the user can use the tube 303 as a straw through which the mixture can be exhausted, allowing the user to easily drink the mixture.

FIG. 5 shows a cap according to another embodiment of the present invention.

A cap of this embodiment is identical to the first embodiment except for the following.

In this embodiment, a seal enhancement member is further provided. As a seal enhancement member, a silicon 0-ring 30 may be used. The seal enhancement member 30 may be disposed on the bottom of the supporting tube 203 between the supporting tube 203 and the seal member 202. When the movable member 100 is assembled on the fixing member 200, the bottom of the tube 103 tightly contact the seal enhancement member 30 to provide a reliable seal state.

FIG. 5 shows a cap according to another embodiment of the present invention.

This embodiment is identical to the first embodiment except for the followings.

In this embodiment, a seal member is separated from the supporting tube 203. That is, the seal member is specially prepared and fixedly assembly on the bottom of the supporting tube 203.

It will be apparent to those skilled in the art that various modifications and variations can be made in the present invention. Thus, it is intended that the present invention avers the modifications and variation of this invention provided they come within the scope of the appended claims and their equivalents.

INDUSTRIAL APPLICABILITY

As described above, the present invention is applicable to a large-screen display device by increasing the luminance of the light emitting device. As described above, the present invention is directed to a cap that can be associated with a container to apply a second material contained therein to the primary material contained in the container pouch container through a simple operation. Therefore, the present invention can be applied to a variety of industrial field.

The invention claimed is:

1. A cap containing a secondary material, comprising:

a fixing member fixed on a container, the fixing member having a hollow main body and a supporting tube extending downward from an inner surface of the hollow main body, the supporting tube having a material exhausting portion and a seal member formed on the lower end of the supporting tube;

a movable member threadably coupled to the fixing member, the movable member having a main body coupled on the main body of the fixing member and a tube extending downward from the main body to define a storage chamber for secondary material, the tube being provided with an opened lower end through which the secondary material is filled in the storage chamber, the opened lower end of the tube being tightly interlocked with the seal member formed on the supporting tube of the fixing member after the secondary material is filled in the storage chamber and the movable member is coupled to the fixing member and being released from the seal member so that the secondary material is mixed with a primary material contained in the container by being exhausted into the container through the material exhausting portion formed on the supporting tube of the fixing member when the movable member is moved relative to the fixing member thereby removing the seal and providing an opening between the opened lower end of the tube and the seal member thereby releasing the secondary material from the storage chamber into the primary material; and a stirring projection pin formed on an eccentric portion of the seal member and is configured to stir the secondary material when the movable member is removed from the fixing member, whereby rotation of the moveable member relative to the fixing member causes rotation of the secondary material relative to the stirring projection pin thereby causing stirring of the secondary material.

2. The cap of claim 1, wherein the hollow main body of the fixing member includes a sidewall fixed on the container and a spouting portion extending upward from the sidewall, the movable member is coupled to the spouting portion.

3. The cap of claim 1, wherein the hollow main of the fixing member is screw-coupled to the main body of the movable member.

4. The cap of claim 1, wherein the tube is separated from the main body, the tube being provided with a circumferential top projection that is engaged with a hook projection extending downward from a bottom of the main body.

5. The cap of claim 4, wherein the tube is provided with a circumferential bottom projection that will be hooked on a circumferential projection formed on an inner surface of the supporting tube of the fixing member when the movable member is removed from the fixing member.

6. The cap of claim 1, further comprising a first tamper-proof formed on a lower end of the hollow main body of the fixing member and a second tamper-proof formed on a main body of the movable member.

7. The cap according to claim 1, further comprising a seal enhancement member disposed on a bottom of the supporting tube.

8. The cap according to claim 7, wherein the seal enhancement member is an O-ring.

9. The cap according to claim 8, wherein the O-ring is formed of silicon.

10. The cap according to claim 1, wherein the seal member is separately prepared from the supporting tube and fixedly assembled on the supporting tube.

11. The cap according to claim 1 wherein the fixing member includes threads and is configured to be screwed onto the container.

* * * * *